US007650755B2

(12) United States Patent
Gelber

(10) Patent No.: US 7,650,755 B2
(45) Date of Patent: Jan. 26, 2010

(54) WATER RECIRCULATION SYSTEM FOR BOILER BACKEND GAS TEMPERATURE CONTROL

(75) Inventor: Danny E. Gelber, Enfield, CT (US)

(73) Assignee: ALSTOM Technology Ltd. (CH)

( * ) Notice: Subject to any disclaimer, the term of this patent is extended or adjusted under 35 U.S.C. 154(b) by 244 days.

(21) Appl. No.: 11/693,913

(22) Filed: Mar. 30, 2007

(65) Prior Publication Data

US 2008/0236516 A1 Oct. 2, 2008

(51) Int. Cl.
*F01K 13/00* (2006.01)

(52) U.S. Cl. ..... 60/645; 60/670

(58) Field of Classification Search ..... 60/645, 60/670

See application file for complete search history.

(56) References Cited

U.S. PATENT DOCUMENTS 2,464,750 A * 3/1949 Nalven ..... 122/411
2,816,526 A * 12/1957 Dalin ..... 122/235.11
2,818,837 A * 1/1958 Frisch ..... 122/240.1
2,841,102 A * 7/1958 Marshall ..... 110/106
3,095,699 A * 7/1963 Baver ..... 60/783
3,265,044 A * 8/1966 Juchtern ..... 122/510
3,478,726 A 11/1969 Kikinis
4,465,027 A 8/1984 Steinegger
4,841,722 A 6/1989 Bjorge
5,713,311 A * 2/1998 Fitzgerald ..... 122/406.5
6,609,483 B1 8/2003 Albrecht et al.
2002/0083903 A1 7/2002 Liebig

FOREIGN PATENT DOCUMENTS

EP 0 281 151 A 9/1988

OTHER PUBLICATIONS

PCT International Search Report and The Written Opinion of the International Searching Authority dated Jun. 24, 2009—(PCT/US2008/058389).

* cited by examiner

*Primary Examiner*—Hoang M Nguyen
(74) *Attorney, Agent, or Firm*—Cantor Colburn LLP

(57) ABSTRACT

A water recirculation system for a steam power plant includes a tapoff line which receives water from a downcomer, and an economizer link which receives water from the tapoff line and transports the water to an economizer.

18 Claims, 4 Drawing Sheets

WATER RECIRCULATION SYSTEM FOR BOILER BACKEND GAS TEMPERATURE CONTROL

TECHNICAL FIELD

The present disclosure relates generally to a water recirculation system and, more particularly, to a water recirculation system for power plant backend gas temperature control.

BACKGROUND

Increasingly stringent regulations governing the emissions of power plants will force power plant operators to run selective catalytic reduction (SCR) systems year round in order to reduce nitrous oxide (NOx) emissions. Currently, most power plants utilize their SCR systems only during an "ozone season", a period from May to September when ozone emission must be controlled especially carefully.

The ozone season corresponds to a period of peak electrical demand when power plants are running at maximum capacity. Therefore, existing SCR systems were designed to be operated within a narrow range of exhaust temperatures corresponding to the exhaust temperatures reached by power plants operating at that maximum capacity, also known as maximum continuous rating (MCR). For example, SCR systems may have a maximum operating temperature of about 700° F. at full load and a minimum operating temperature for catalyst operation of about 620° F. This difference between maximum and minimum SCR operating temperatures defines the SCR control range of the power plant. At low load the flue gas temperature produced by the power plan may be only 580° F., well outside the SCR control range.

When power plants are operated at less than their MCR, (e.g., at low load), their exhaust temperatures are reduced accordingly. Many power plants operate at less than MCR for six or seven months of the year. This presents a problem in that, for most of the year, power plants do not produce exhaust gases within the relatively narrow temperature range required by their existing SCR systems.

One approach to complying with the more stringent ozone regulations would be to replace the existing SCR systems with new systems designed to operate at a wider range of temperatures corresponding to various power plant output levels. However, installing the new systems would represent a substantial financial investment, the new systems would be significantly larger than the existing systems (up to an order of magnitude larger) and would require extensive, often infeasible, retrofitting design modifications.

In order to avoid having to install new SCR systems, various methods have been proposed to keep the exhaust temperature within the range of the existing SCR systems even when the power plant operates at reduced loads. These methods include economizer resurfacing, gas bypass systems, and split economizers, all of which present their own substantial design and cost limitations.

The increasingly stringent regulations continue to place pressures upon electric utilities to reduce plant emissions. Replacing the existing SCR systems, which have limited operating conditions, is not an economic possibility at most power plants. In addition, the above-described modifications to existing power plants are often problematic due to their space requirements and their high maintenance and installation costs. Therefore, improvements that allow for more economic and space efficient modifications to existing power plants are required.

SUMMARY

According to the aspects illustrated herein, there is provided a water recirculation system for a steam power plant including; a tapoff line which receives water from a downcomer, and an economizer link which receives water from the tapoff line and transports the water to an economizer.

According to the other aspects illustrated herein, there is provided a steam power plant including; a furnace including a plurality of waterwalls, a steam drum in fluid communication with the plurality of waterwalls, at least one downcomer extending from the steam drum, a tapoff line which receives water from the at least one downcomer, and an economizer link which receives water from the tapoff line and transports the water to an economizer.

According to the other aspects illustrated herein, there is provided a method of controlling backend gas temperature of a steam power plant, the method including; diverting water form a downcomer to a tapoff line, and transporting the water from the tapoff line to an economizer.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Disclosed herein are exemplary embodiments of a water recirculation system which allows the operators of natural and subcritical pressure boilers to control exit gas temperature, especially at loads below maximum continuous rating (MCR), so that the backend equipment can operate in the proper gas temperature range which optimizes performance.

Figure 1:
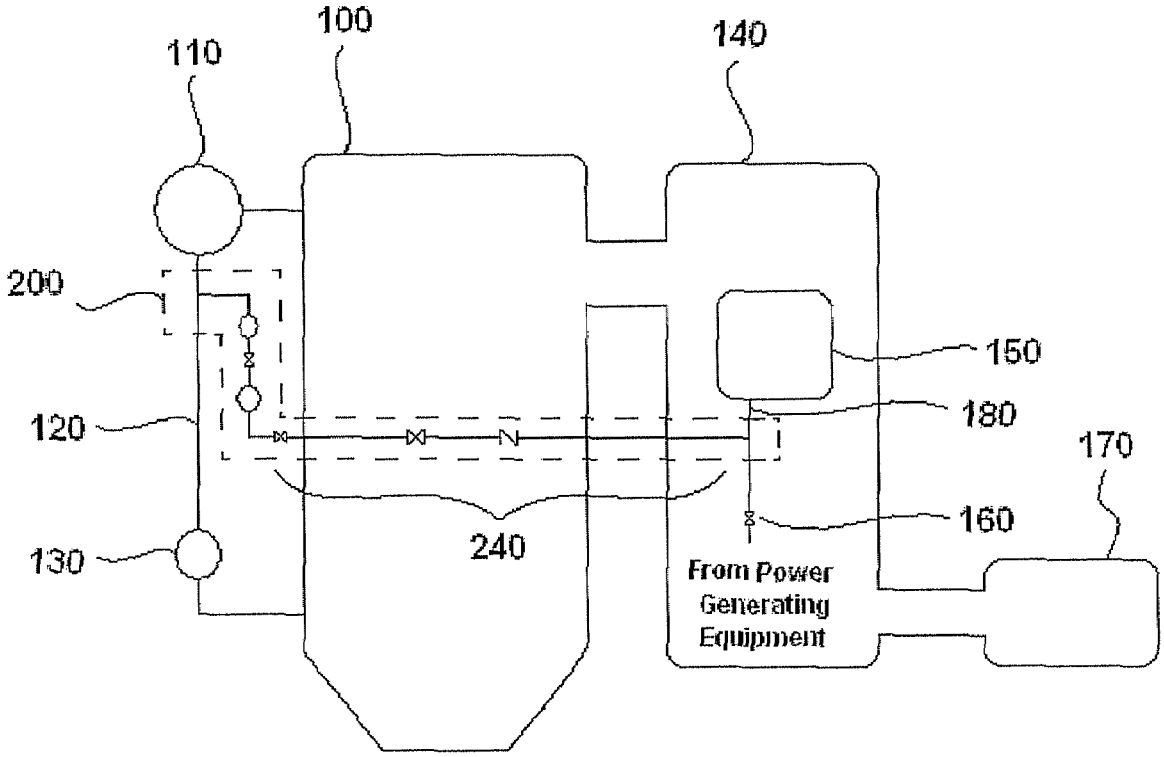
FIG. 1 is a schematic diagram of a power plant including a water recirculation system suitable for use in accordance with an exemplary embodiment of the invention.

Referring now to FIG. 1, there is illustrated a schematic diagram of a power plant including a water recirculation system suitable for use in accordance with an exemplary embodiment of the invention. In particular, the power plant includes a furnace 100 which combusts fuel to produce heated exhaust gases. The furnace 100 includes a plurality of waterwalls (not shown) running along the inside thereof. The furnace 100 transfers heat from the combustion of fuel and exhaust gases to water running through the waterwalls. The heated water then flows to a steam drum 110 where steam is separated therefrom. The steam is transported to power generating equipment (not shown) or to further heating equipment such as a superheater (not shown). The remaining heated water goes down a downcomer 120 and is returned to the plurality of waterwalls. In one exemplary embodiment the water is pumped down the downcomer 120 by a boiler circulation pump 130. Alternative exemplary embodiments, such as when the boiler is a natural circulation boiler, include configurations wherein the boiler recirculation pump 130 is omitted. The downcomer 120 may be any piping or tubing which transports water from the steam drum 110 to the furnace 100 in order to complete circulation to the furnace 100.

The heated exhaust gases pass from the furnace 100 to a convective pass 140. The exhaust gases then transfer energy to an economizer 150 disposed in the convective pass 140. The amount of energy transferred to the economizer 150 depends on several factors including, for example, its surface area and the temperature of the fluids flowing therethrough. The primary function of the economizer 150 is to heat water returning from the power generating equipment before sending the water to the steam drum 110. The water returning from the power generating equipment is called economizer feedwater. The exhaust gases are cooled by the transfer of energy to the economizer 150. The economizer 150 also includes a feedwater shutoff valve 160 which allows the flow of water to the economizer 150 to be controlled for maintenance or other purposes. The economizer 150 may be any heat exchange device which heats water returning from the power generating equipment before that water is returned to the furnace 100. In one exemplary embodiment the economizer 150 is a collection of closely wound tubes disposed along the edges of the convective pass 140.

The cooled exhaust gases are then passed to backend equipment such as a selective catalytic reduction (SCR) system 170 where nitrous oxides (NOx) are removed. As described above, the SCR systems 170 installed in most existing power plants are designed to operate only in a temperature range corresponding to the exhaust temperature of the convective pass 140 when the furnace 100 is operating at or near the maximum continuous rating (MCR). This presents a problem when nitrous oxides must be removed when the furnace 100 is run at loads substantially less than MCR.

Accordingly, the power plant of FIG. 1 may be retrofit to include a water recirculation system 200 as described below. However, the inclusion of a water recirculation system 200 is not limited to a retrofit power plant; new power plants may be constructed with the water recirculation system 200 as part of their original design.

Figure 2:
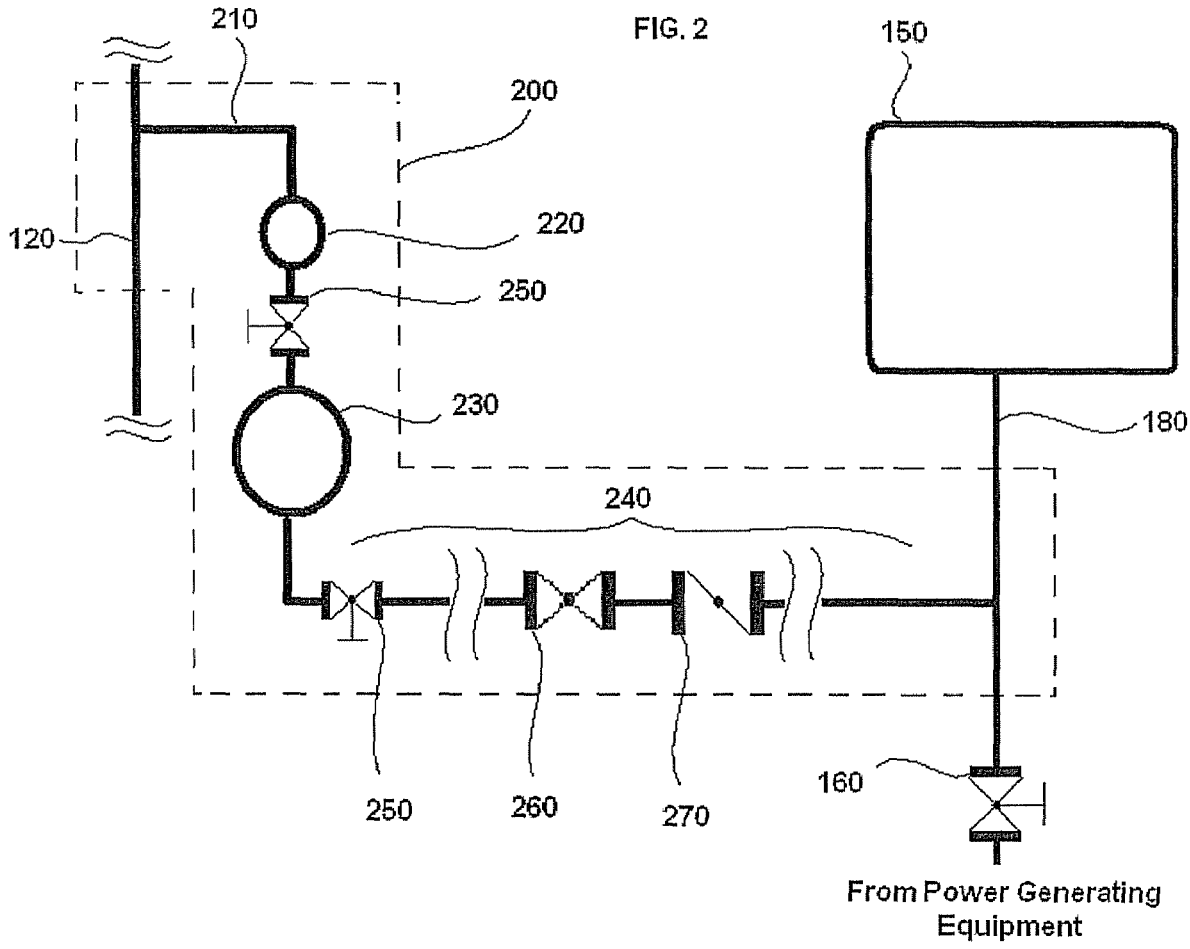
FIG. 2 is an enlarged view of the water recirculation system illustrated in FIG. 1, configured in accordance with an exemplary embodiment.

Referring now to FIGS. 1 and 2, an exemplary embodiment of a water recirculation system 200 includes a tapoff line 210 which diverts water from the downcomer 120 to a collection manifold 220. The water from the downcomer is at or slightly below saturation temperature (e.g., about 688° F. at a pressure of about 2850 psig).

A recirculation pump 230 pumps water from the tapoff line 210 to an inlet 180 of the economizer 150 through an economizer link 240. The recirculation pump 230 may be isolated for maintenance by a pair of shutoff valves 250. This allows the power plant to operate even if the recirculation pump 230 is removed. In one exemplary embodiment, the economizer link 240 may be made from substantially the same material as the downcomer 120 and the tapoff line 210.

Water at or near the saturation temperature from the economizer link 240 is mixed with colder economizer feedwater returning from the power generating equipment as they both enter the inlet 180 to the economizer 150. Alternative exemplary embodiments include configurations wherein the mixing takes place in the economizer 150 itself or anywhere along the piping containing the economizer feedwater. By mixing these two fluids, the temperature of water input to the economizer 150 increases, which in turn decreases the amount of energy absorbed from the surrounding exhaust gases. The economizer 150 absorbs energy according to the log mean temperature difference between the water flowing therethrough and the outside exhaust gases. When the temperature of the water in the economizer 150 is increased, the economizer 150 absorbs less energy from the exhaust gases. The result is an increase in the temperature of the economizer exit gas.

The water recirculation system 200 prevents the economizer 150 from cooling the exhaust gases beyond the minimum operating temperature of the SCR systems 170 when the power plant is run at loads less than MCR.

A control valve 260 may be disposed along the economizer link 240 and may be opened or shut to a varying degree to control the flow of water to the inlet 180 of the economizer 150. The control valve 260 allows for precise control of the amount of recirculated water traveling along the economizer link 240 and therefore also allows for precise control of the economizer exit gas temperature. Because the economizer exit gas temperature may be precisely controlled, the water recirculation system 200 may be operated at a variety of power plant operating loads. In one exemplary embodiment, the water recirculation system 200 is turned off while the power plant operates at MCR. Another advantage of the water recirculation system 200 according to the present embodiments is that the control of the exhaust gas temperature is achieved using few moving parts. Moreover, any moving parts that are used may be relatively easily replaced. Also, the water recirculation system 200 according to the present embodiments can control backend gas temperature without the need for expensive ductwork modifications to reroute exhaust gases.

A check valve 270, also called a backflow valve, may also be disposed along the economizer link 240 and prevents water from flowing backwards from the economizer 150 towards the downcomer 120 when the water recirculation system 200 is turned off. The check valve 270 may also prevent backflow along the economizer link 240 in the event of a malfunction such as the failure of the hot water recirculation pump 230.

Figure 3:
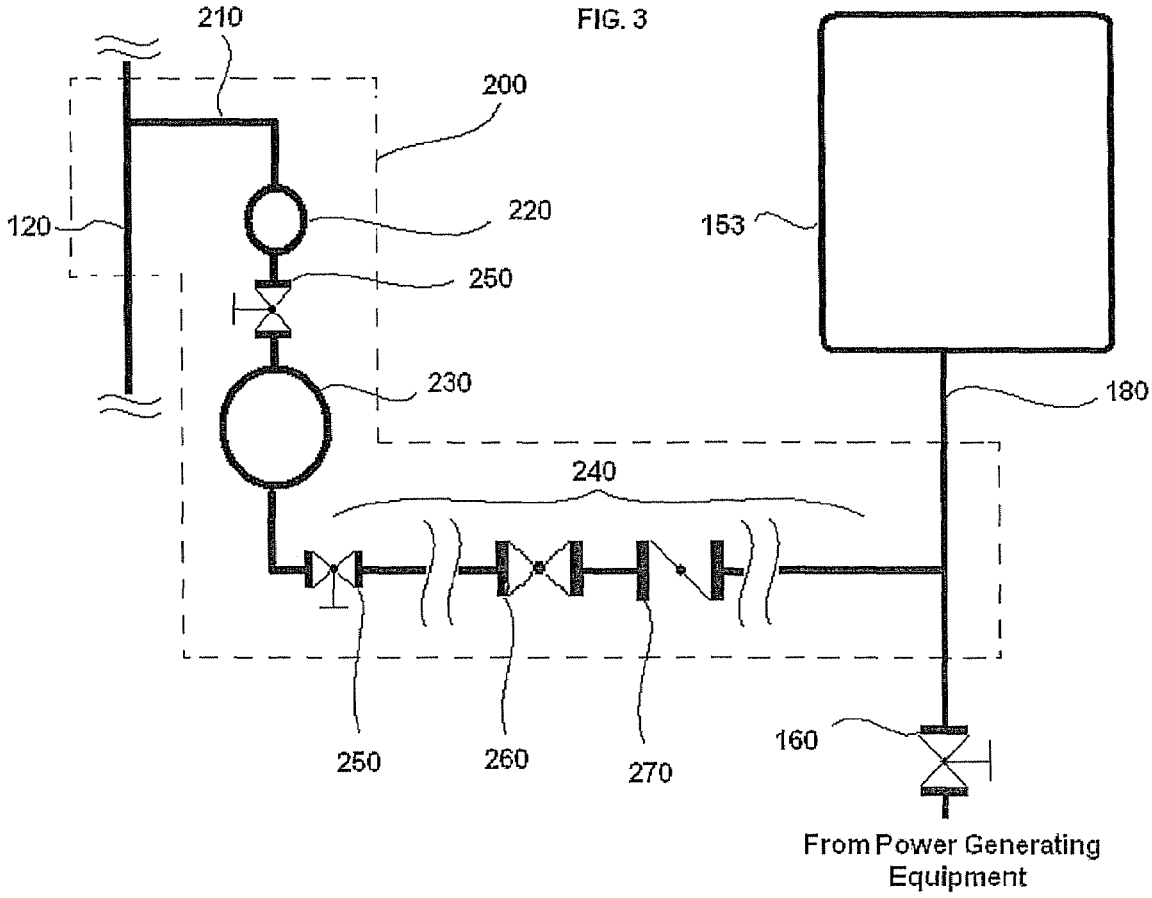
FIG. 3 is an enlarged view of an alternative embodiment of the water recirculation system illustrated in FIG. 1.
Figure 4:
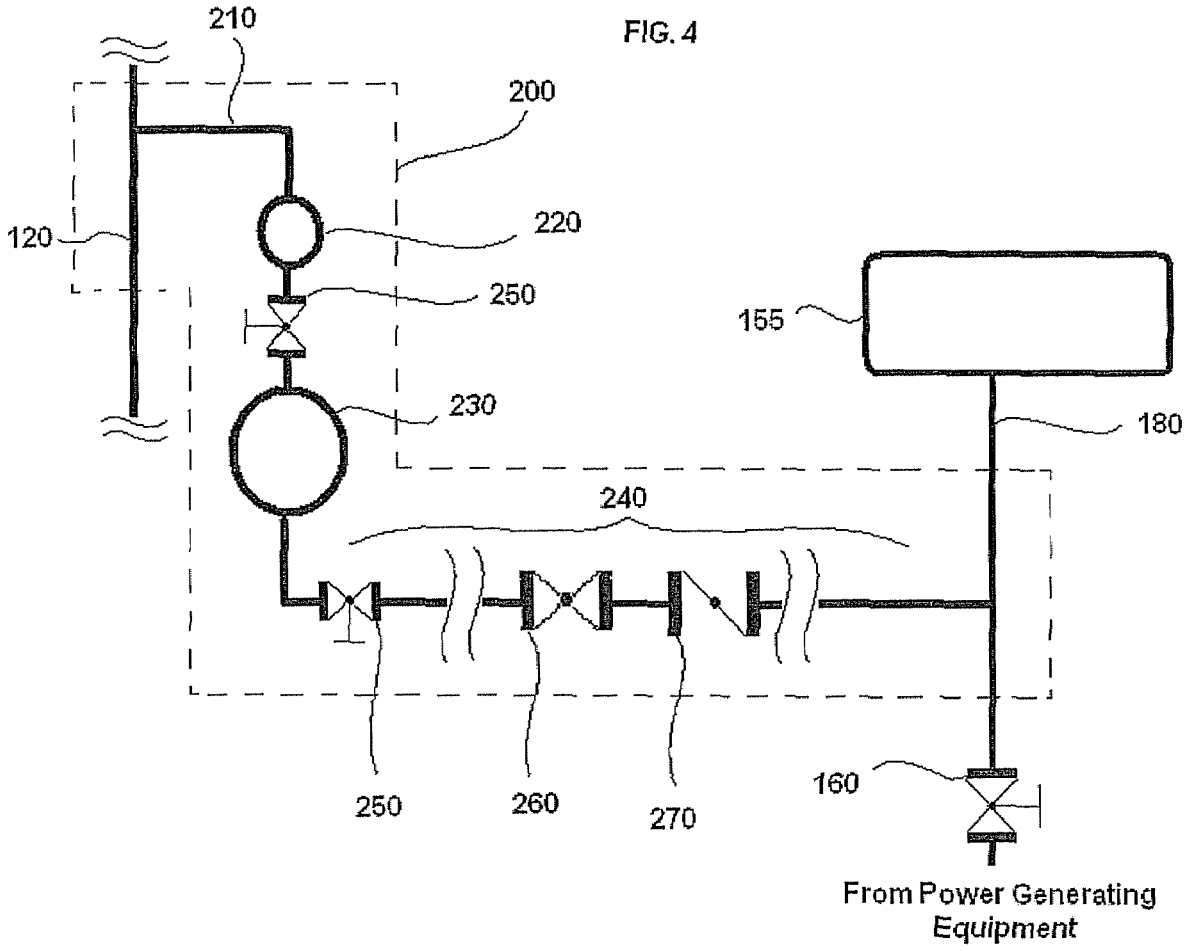
FIG. 4 is an enlarged view of still an alternative embodiment of the water recirculation system illustrated in FIG. 1.

Referring generally to FIGS. 3 and 4, in accordance with additional exemplary embodiment of the present invention, the water recirculation system 200 may be used in conjunction with another backend gas temperature controlling technique, such as modifying the surface area of the economizer 150 for example. The use of multiple backend gas temperature control methods provides power plant designers and operators with a wide range of options for adjusting backend gas temperatures at lower loads.

Referring to FIG. 3, in one such exemplary embodiment, the water recirculation system 200 is substantially as described above, along with additional surface area added to the economizer 150 (with respect to the economizer 150 of FIG. 2). Additional area may be added to the economizer 150 by (for example) adding economizer tubing, changing the surface type (e.g., from a bare tube economizer to an In-Line Spiral Fin Surface (SFS) design) or various other well-known methods. The added surface area will allow the modified economizer 153 to absorb more energy from the exhaust gases, which in turn improves the efficiency of the power plant but also lowers the backend gas temperature to the SCR systems 170. The water recirculation system 200 can prevent the modified economizer 153 from absorbing too much heat from the exhaust gases as described above and thereby maintain the backend gas temperature within the operating range of the SCR systems 170.

Referring to FIG. 4, in another exemplary embodiment the water recirculation system 200 is substantially as described above, but with the surface area of the economizer 155 reduced (with respect to the economizer 150 of FIG. 2). The surface area may be reduced by (for example) removing economizer tubing, changing the surface type (e.g., from an In-Line SFS design to a bare tube design) or various other well-known methods. The modified economizer 155 absorbs less energy from the exhaust gases, which in turn increases the backend gas temperature to the SCR systems 170. Because the backend gas temperature is increased by the reduced surface area of the economizer 155, substantially less water flow may be required from the water recirculation system 200 in order to maintain the backend gas temperature within the operating range of the SCR systems 170. This may present advantages such as the use of smaller diameter, and therefore less expensive, piping in the economizer link 240, the use of a less powerful and smaller recirculation pump 230, or an extended control range and various other advantages.

While the exemplary embodiments have been described with respect to increasing the temperature of exhaust gases introduced to an SCR system, one of ordinary skill in the art would understand that the exemplary embodiments of a water recirculation system may be used in any application where the control of gas temperature at the backend of a power plant is desired.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A water recirculation system for a steam power plant comprising:

a tapoff line which receives heated water from a downcomer; and an economizer link which receives heated water from the tapoff line and transports the heated water to an economizer inlet where the heated water is mixed with cold economizer feedwater.

2. The water recirculation system of claim 1 further comprising:

a collection manifold disposed between the tapoff line and the economizer link.

3. The water recirculation system of claim 1 further comprising:

a recirculation pump disposed between the tapoff line and the economizer link.

4. The water recirculation system of claim 3 further comprising:

a control valve disposed between the recirculation pump and the economizer link.

5. The water recirculation system of claim 4 further comprising:

a check valve disposed between the control valve and the economizer link.

6. The water recirculation system of claim 3 further comprising:

a plurality of isolation valves including a first shutoff valve disposed between the tapoff line and the recirculation pump and a second shutoff valve disposed between the recirculation pump and the economizer link.

7. A steam power plant comprising:

a furnace including a plurality of waterwalls which heat water therein;

a steam drum in fluid communication with the plurality of waterwalls;

at least one downcomer which provides heated water to the furnace; and a tapoff line which receives heated water from the at least one downcomer; and an economizer link which receives heated water from the tapoff line and transports the heated water to an economizer inlet where the heated water is mixed with cold economizer feedwater.

8. The steam power plant of claim 7 further comprising:

a collection manifold disposed between the tapoff line and the economizer link.

9. The steam power plant of claim 7 further comprising:

a recirculation pump disposed between the tapoff line and the economizer link.

10. The steam power plant of claim 9 further comprising:

a control valve disposed between the recirculation pump and the economizer link.

11. The steam power plant of claim 10 further comprising:

a check valve disposed between the control valve and the economizer link.

12. The steam power plant of claim 9 further comprising:

a plurality of isolation valves including a first shutoff valve disposed between the tapoff line and the recirculation pump and a second shutoff valve disposed between the recirculation pump and the economizer link.

13. A method of controlling backend gas temperature of a steam power plant, the method comprising:

diverting heated water from a downcomer to a tapoff line;

transporting the heated water from the tapoff line to an economizer; and combining the heated water from the tapoff line with cool economizer feedwater.

14. The method of claim 13 further comprising:

collecting the water before transporting the water from the tapoff line to the economizer.

15. The method of claim 13 wherein the transporting the heated water from the tapoff line to an economizer includes pumping the water through a recirculation pump.

16. The method of claim 15 further comprising:

controlling a flow of the water from the recirculation pump to the economizer with a control valve.

17. The method of claim 13 further comprising:

increasing the surface area of an existing economizer to form the economizer to which the heated water from the tapoff line is transported.

18. The method of claim 13 further comprising:

decreasing the surface area of an existing economizer to form the economizer to which the heated water from the tapoff line is transported.

* * * * *

UNITED STATES PATENT AND TRADEMARK OFFICE

CERTIFICATE OF CORRECTION

PATENT NO. : 7,650,755 B2
APPLICATION NO. : 11/693913
DATED : January 26, 2010
INVENTOR(S) : Gelbar It is certified that error appears in the above-identified patent and that said Letters Patent is hereby corrected as shown below:

Title page item 75
Inventor's name was incorrectly published on granted patent as: Gelber
The correct spelling of the inventor's last name is: Gelbar Signed and Sealed this Twentieth Day of July, 2010

David J. Kappos

David J. Kappos
*Director of the United States Patent and Trademark Office*